US006773227B2

(12) United States Patent
Montgomery

(10) Patent No.: US 6,773,227 B2
(45) Date of Patent: Aug. 10, 2004

(54) WHEEL SPACE PRESSURE RELIEF DEVICE

(75) Inventor: Michael E. Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 13 days.

(21) Appl. No.: 10/340,253

(22) Filed: Jan. 10, 2003

(65) Prior Publication Data

US 2004/0136828 A1 Jul. 15, 2004

(51) Int. Cl.[7] ..... F01D 25/24
(52) U.S. Cl. ..... 415/144; 415/173.7
(58) Field of Search ..... 415/111, 116, 415/144, 168.1, 168.2, 168.4, 169.1, 173.7, 174.5, 191, 211.2; 416/248

(56) References Cited

U.S. PATENT DOCUMENTS 2,336,323 A * 12/1943 Warren ..... 415/173.7
3,756,740 A * 9/1973 Deich et al. ..... 415/173.7
4,335,995 A * 6/1982 Riollet et al. ..... 415/144

* cited by examiner

*Primary Examiner*—Edward K. Look
*Assistant Examiner*—Richard A. Edgar
(74) *Attorney, Agent, or Firm*—Polster, Lieder, Woodruff & Lucchesi, L.C.

(57) ABSTRACT

A steam turbine has a diaphragm (20) and a rotor/bucket assembly (1). Steam directed to the assembly flows through the diaphragm. A setback (38*b*) is formed in a root setback face (38) of the diaphragm adjacent the assembly, and a plurality of grooves (36) formed in the setback provide a steam flow path ($Q_f$) between the diaphragm and rotor/bucket assembly. The grooves are radially extending grooves extending the height of the setback, and the number, width, and spacing of the grooves are a function of the design of the steam turbine. When the steam turbine is in a fully closed position, the grooves provide a steam flow path by which upstream pressure on the rotor/bucket assembly is relieved and damage to the assembly prevented.

11 Claims, 2 Drawing Sheets

WHEEL SPACE PRESSURE RELIEF DEVICE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to steam turbines; and more particularly, to upstream wheel space pressure relief in a turbine so to eliminate steam balance holes now required in turbine blades to divert steam flow in certain conditions to maintaining acceptable thrust bearing loads.

Current steam turbine designs incorporate steam balance holes which are formed in the portion of a blade (bucket) where it attaches to a rotor, or in rotor disks. These holes provide a flow path for steam leakage through the seals of stationary turbine parts, through seals installed adjacent a rotor, and flow from the root of a stage between a nozzle and a bucket. Regardless of where the balance holes are located, their function is to maximize efficiency of turbine stage and keep thrust bearing loads within acceptable limits.

Over time, the size of balance holes has gotten progressively smaller. Recent analyses have shown that optimization (elimination) of the steam balance hole area results in significant improvement in the stage efficiency. Two reasons for this improvement are first, increases in energy reaction within a turbine stage, and second, an improved understanding of what actually happens within the stage. As these trends continue, it is reasonable to expect steam balance holes may eventually be eliminated altogether.

There are concerns, however. A primary concern is what will happen in emergency situations if there are no steam balance holes. This concern is particularly important in situations where a turbine stage is in its fully closed position. When this situation occurs, upstream wheel space pressure within the stage will approach that of the stage bowl, and the resulting high pressure will greatly increase the rotor's axial thrust which can damage the rotor's bearing necessitating turbine down time and expensive repairs. As is known in the art, axial thrust is normally balanced by a combination of balance pistons, steam flow paths running in opposite directions, split or double flow steam paths, and thrust bearings which are appropriately sized.

Large thrusts bearings have thermodynamic losses associated with oil flow, friction, and windage. These factors must be considered in the design of a turbine, and steam balance holes have heretofore been one way of doing so. If balance holes are eliminated, the effect of these factors must otherwise be accounted for. Further, in retrofit applications, the complexity and expense of modifying or replacing existing thrust bearings makes elimination of balance holes impractical.

The present invention provides a method by which steam balance holes can be eliminated while not effecting the desired thrust design.

BRIEF SUMMARY OF THE INVENTION

Briefly stated, the present invention provides a modification to current design of a steam turbine by which steam balance holes are eliminated without effecting the performance of the turbine and which does not allow a rotor's axial thrust to significantly increase even in emergency situations such as when the turbine stage is in its fully closed position. This arrangement will prevent thrust bearing failure. The modification comprises forming a plurality of grooves in the root setback face of a diaphragm for the stage. The grooves now provide a steam flow path between the diaphragm and a rotor/bucket assembly rather than the steam balance holes which heretofore have provided the path. The resultant flow path relieves upstream wheel space pressure even when the stage is fully closed. The steam balance holes can be eliminated.

The foregoing and other objects, features, and advantages of the invention as well as presently preferred embodiments thereof will become more apparent from the reading of the following description in connection with the accompanying drawings. The invention allows elimination of the steam balance hole area, facilitating optimization of stage efficiency, whilst maintaining acceptable thrust design.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

Figure 1:
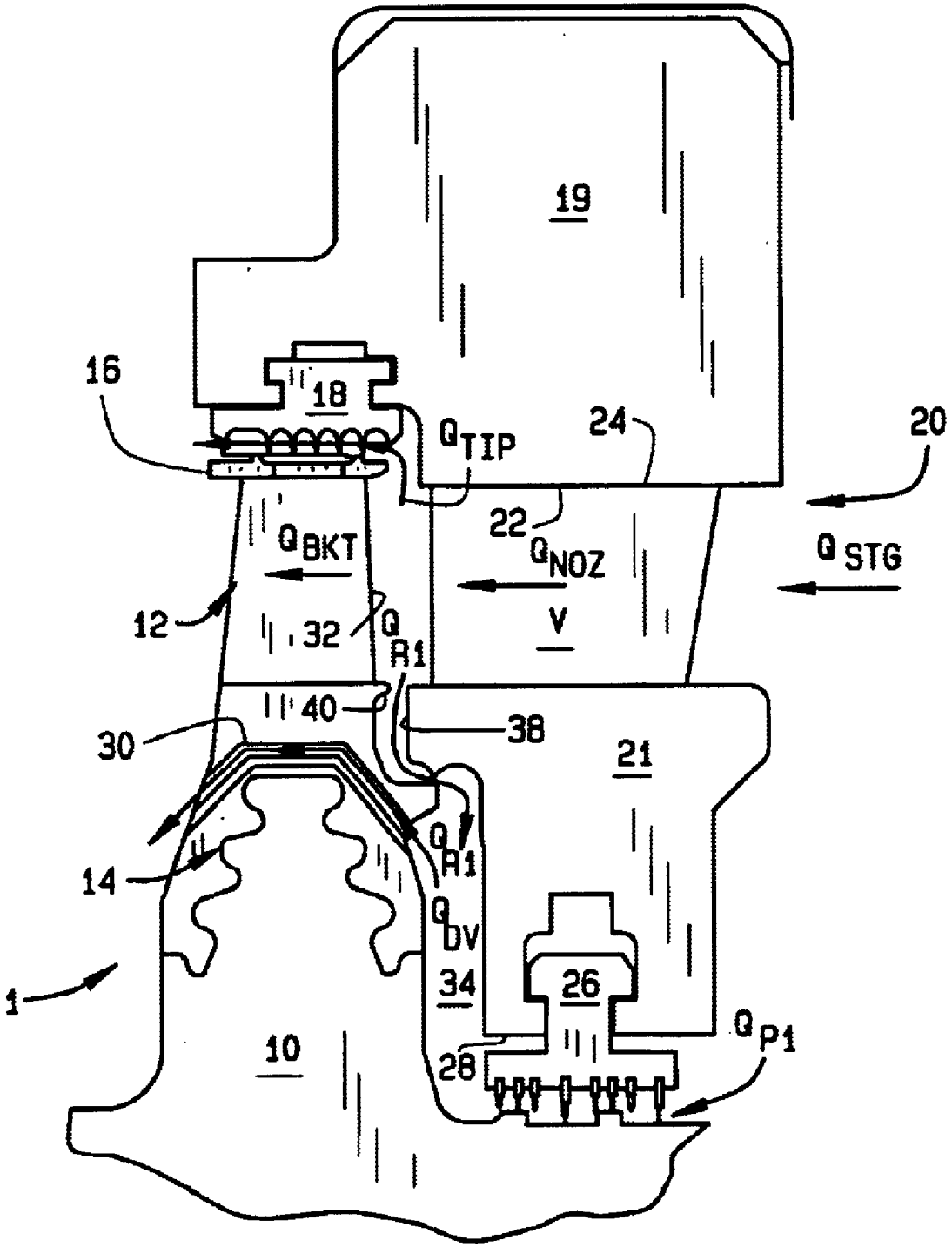
FIG. 1 PRIOR ART
FIG. 1 is an elevation view of a portion of a steam turbine stage.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Referring to the drawings, a rotor/bucket assembly 1 includes a rotor 10 for a stage of a steam turbine. A plurality of blades or buckets 12 are mounted on the rotor using a dovetail connection as generally indicated at 14. A cover 16 fits over the outer end of the blades to protect the blades from damage, and a seal 18 is installed between the tip end of the bucket and the cover. The seal is supported in a ring 19, and the axial position of the rotor relative to the stationary components is supported by a thrust bearing (not shown).

Figure 2:
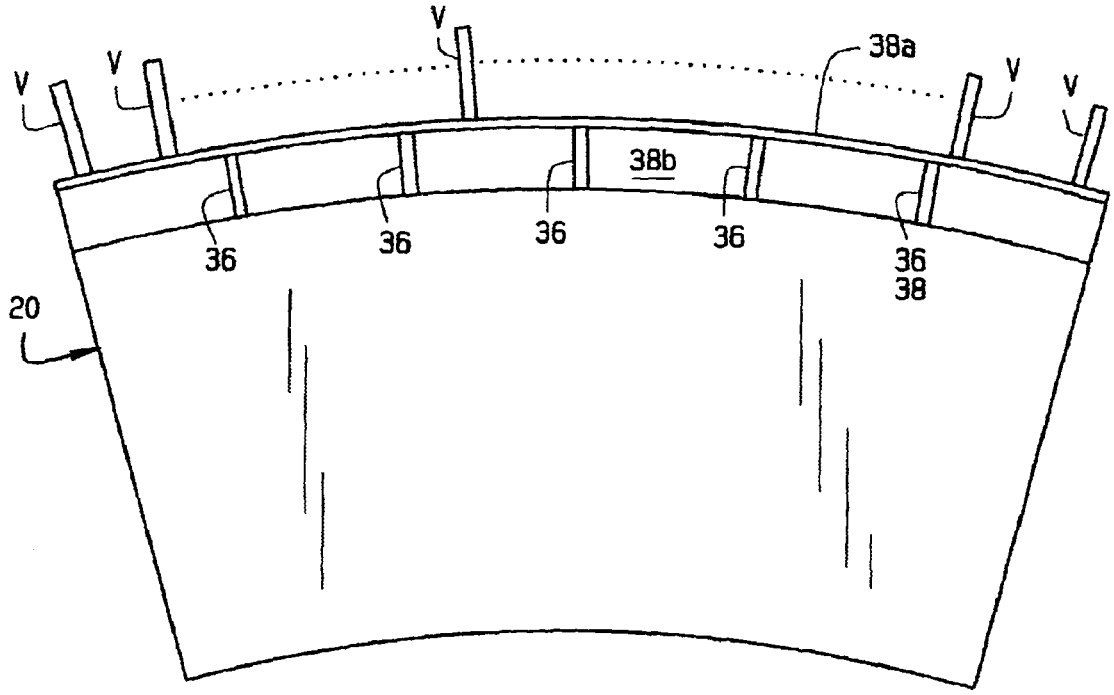
FIG. 2 is a elevation of a portion of a diaphragm root set back face in which grooves or slots are formed to provide a bypass passage to balance pressures within the stage; and, FIG. 3 is an enlarged portion of the adjoining faces of the root setback and bucket illustrating a balance pressure flow path of the present invention when the stage is closed.

A diaphragm indicated generally 20 is installed upstream of the rotor/bucket assembly. The diaphragm is generally circular in shape and a plurality of vanes V (sometimes referred to as "nozzles") extend radially outward between web 21 and ring 19 of the diaphragm. As shown in FIG. 2, the vanes are spaced about the periphery of the diaphragm at regular intervals. The number of vanes, their spacing, etc., are a function of the particular steam turbine design in which they are used. The height of the vanes is such that their outer ends 22 are adjacent an inner end of 24 of the ring. Packing ring 26 is installed around an inner surface 28 of web 21 to provide a seal between rotor 10 and the diaphragm. Those skilled in the art will recognize that while the buckets 12 rotate with rotor 10, diaphragm 20 and the vanes are stationary.

Referring again to FIG. 1, fluid flow through the stage is from right to left as indicated by the arrows. The total steam flow into the stage is indicated by the arrow $Q_{stg}$ The majority of the steam flow is through the vanes and is indicated $Q_{noz}$. The majority of flow through the vanes is directed at the rotor/bucket assembly and is indicated $Q_{bkt}$. However, some of the steam flow is diverted about diaphragm 20 and flows through packing seal 26. This flow is indicated $Q_{pl}$. Similarly, a portion of the steam passing through the vanes is diverted between the rotor/bucket assembly and the diaphragm. This flow is indicated $Q_{rl}$ in FIG. 1. A further portion of the flow is diverted around the tips of the blades and is indicated $Q_{tip}$.

In conventional steam turbines, balance holes 30 are formed in the buckets in the area of their attachment to a hub of the rotor. As noted, the balance holes serve two purposes. The first purpose is to prevent flow from the upstream region of the stage into the steam flow path between the outlet or downstream side of diaphragm 20 and a leading edge 32 of the buckets 12. That is, any bypass flow through packing seal 26; the flow $Q_{pl}$, is drawn though the balance holes 30 rather than being allowed to flow up between the inner face of diaphragm 20 and the rotor hub and upstream side of the buckets. The second purpose is to provide a relief path for an upstream face region 34 of the rotor/bucket assembly in emergency situations such as differential expansions excursions (maximum stage closure) and water induction incidents. As previously noted, there is a concern that, for example, during a maximum closure condition for the stages, the absence of steam balance holes 30 will result in upstream substantial pressures in the region 34 that produce large thrust loads and potential failure of the thrust bearing supporting the rotor.

Figure 3:
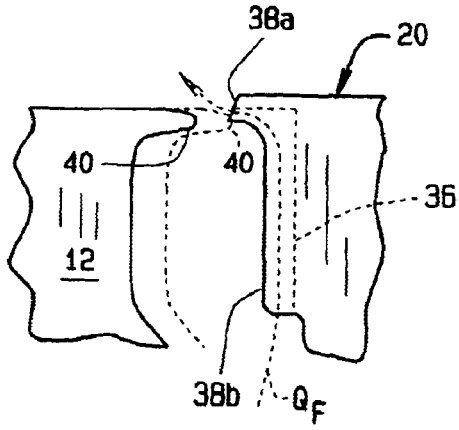

In accordance with the present invention, a plurality of radially extending grooves or slots 36 are formed in a root setback face 38 of diaphragm 20. The number, width, height, and spacing of the grooves are a function of the turbine design and may vary from one turbine design to another. Accordingly, the grooves 36 shown in FIG. 2 are representative only. In FIG. 1, root setback face 38 of diaphragm 20 is shown to be uniform. As shown in FIG. 3, and in accordance with the invention, root setback face 38 now has an upper portion 38*a* and a lower setback portion 38*b*. The grooves 36 are formed in the setback portion 38*b* of the root setback face, which is now a greater distance from the rotor/bucket assembly than the upper portion 38*a* of the root setback face. Each of the grooves is shown to have a height corresponding to that of the setback. The upper portion 38*a* of the root setback face now forms a lip extending circumferentially about the diaphragm and the upper ends of each groove are formed in the underside of the lip as shown in FIG. 3.

Bucket 12 is shown in the drawings to have bucket root deflector 40 comprising a knife edge extending toward root setback face 38 of diaphragm 20. Under normal turbine operating conditions, the spacing between the bucket and root setback face 38 of diaphragm 20 is shown by the solid line construction in FIG. 3. However, in certain operating conditions, such as a totally closed condition, the rotor/bucket assembly moves toward its dashed line position shown in FIG. 3. However, because of the grooves 36 now formed in the setback portion 38*b* of root setback face 38, there is still a flow path $Q_f$ around diaphragm 20 to relieve the upstream pressure. This situation occurs because, even if the rotor/bucket assembly is deflected so far to the right that the knife edge 40 of the respective buckets moves adjacent setback 38*b*, steam will flow through and over the knife edge through the grooves.

Finally, although not shown in the drawings, those skilled in the art will understand that the grooves 36 do not only have to be radially extending grooves. They could also be radial-axial grooves, radial tangential (i.e., circumferential) grooves, or some other arrangement so long as the bypass feature is maintained.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In a steam turbine having a diaphragm (20) and a rotor/bucket assembly (1), steam directed to the rotor/bucket assembly flowing through the diaphragm to the rotor/bucket assembly, the improvement comprising:

a setback (38*b*) formed in a root setback face (38) of the diaphragm adjacent the rotor/bucket assembly; and, at least one groove formed in the setback to provide a steam flow path ($Q_f$) between the diaphragm and rotor/bucket assembly whereby when the steam turbine is in a fully closed position, the groove provides a steam flow path by which upstream pressure on the rotor/bucket assembly is relieved thereby to prevent damage to the assembly.

2. The improvement of claim 1 further including a plurality of grooves formed in the setback of the root setback face.

3. The improvement of claim 2 in which the number, width, and spacing of the grooves are a function of the design of the steam turbine.

4. The improvement of claim 2 in which the grooves are radially extending grooves extending the height of the setback.

5. The improvement of claim 4 in which the root setback face has portion (38*a*) not setback and comprising a lip extending over the setback and an upper end of the grooves is formed in the lip.

6. In a steam turbine having a diaphragm (20) and a rotor/bucket assembly (1), steam directed to the rotor/bucket assembly flowing through the diaphragm to the rotor/bucket assembly, at least one groove (36) formed in a root setback face (38) of the diaphragm adjacent the rotor/bucket assembly to provide a steam flow path ($Q_f$) between the diaphragm and rotor/bucket assembly whereby when the steam turbine is in a fully closed position, the groove provides a steam flow path by which upstream pressure on the rotor/bucket assembly is relieved thereby to prevent damage to the assembly.

7. The steam turbine of claim 6 in which the root setback face of the diaphragm has a setback (38*b*) formed therein and the groove is formed in the setback.

8. The steam turbine of claim 7 in which the root setback face has portion (38*a*) not setback and comprising a lip extending over the setback and an upper end of the groove is formed in the lip.

9. The steam turbine of claim 8 further including a plurality of grooves formed in the setback of the root setback face.

10. The steam turbine of claim 9 in which the grooves are radially extending grooves extending the height of the setback.

11. The steam turbine of claim 9 in which the number, width, and spacing of the grooves are a function of the design of the steam turbine.

* * * * *